US006283458B1

(12) United States Patent
Cox et al.

(10) Patent No.: US 6,283,458 B1
(45) Date of Patent: Sep. 4, 2001

(54) FILTER WITH HANDLE FEATURE

(75) Inventors: Paul Cox, Haverhill; Thomas S. Chan, Brighton, both of MA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/440,453

(22) Filed: Nov. 15, 1999

(51) Int. Cl.[7] ..... B01F 3/04
(52) U.S. Cl. ..... 261/30; 261/107
(58) Field of Search ..... 261/99, 104, 107, 261/30; 55/357

(56) References Cited

U.S. PATENT DOCUMENTS

| | | | | |
|---|---|---|---|---|
| 1,834,092 | * | 12/1931 | Decrow | 261/99 |
| 1,841,250 | * | 1/1932 | Merryweather | 55/357 |
| 1,916,907 | * | 7/1933 | Sargent | 261/107 |
| 2,388,933 | * | 11/1945 | Pearson | 261/107 |
| 2,453,206 | * | 11/1948 | Donat | 55/357 |
| 3,285,637 | * | 11/1966 | Taussig | 55/357 |
| 5,037,583 | * | 8/1991 | Hand | 261/107 |
| 5,250,232 | * | 10/1993 | Pepper et al. | 261/107 |
| 5,374,381 | * | 12/1994 | Schuld et al. | 261/107 |
| 6,149,138 | * | 11/2000 | Birdsell | 261/107 |

FOREIGN PATENT DOCUMENTS

| | | | | |
|---|---|---|---|---|
| 141528 | * | 5/1903 | (DE) | 261/107 |
| 611255 | * | 3/1935 | (DE) | 261/104 |
| 53145 | * | 5/1937 | (DK) | 261/107 |
| 303961 | * | 1/1929 | (GB) | 55/357 |

* cited by examiner

*Primary Examiner*—C. Scott Bushey

(57) ABSTRACT

A portable humidifier including a housing defining an air inlet, an air outlet, and an air flow path therebetween; a retainer disposed in the housing; and an air permeable, liquid absorbent cartridge element replaceably retained by the retainer and having a handle to facilitate removal from the housing. Also included is a blower disposed in the housing and activatable to produce air flow through the air flow path and cartridge element and a liquid supply for supplying liquid to the cartridge element.

28 Claims, 4 Drawing Sheets

FILTER WITH HANDLE FEATURE

BACKGROUND OF THE INVENTION

The invention relates generally to an evaporative humidifier device, and, more particularly, to an evaporator device utilizing a liquid absorbing element to provide humidification.

Evaporator devices are used extensively to enhance personal comfort by increasing the level of humidity in an enclosed environment. They can function additionally to provide cooling in many hot, dry regions. One well known type of evaporative humidifier employs liquid absorbing wick elements that produce by capillary action liquid flow from a reservoir to wick portions disposed in a path of airflow provided by an electrical blower. Operating efficiency of such humidifiers is significantly diminished by dirt particles which accumulate and contaminate the wick element employed. Consequently, maintenance of operation efficiency requires frequent replacement of contaminated wick elements. Such replacement typically entails undesirable human contact with contaminated portions of the filter elements.

The object of this invention, therefore, is to provide a portable humidifier in which sanitary replacement of filter elements is facilitated.

SUMMARY OF THE INVENTION

The invention is a portable humidifier including a housing defining an air inlet, an air outlet, and an air flow path therebetween; a retainer disposed in the housing; and an air permeable, liquid absorbent cartridge element replaceably retained by the retainer and having a handle to facilitate removal from the housing. Also included is a blower disposed in the housing and activatable to produce air flow through the air flow path and a liquid supply for supplying liquid to the cartridge element. The handle allows replacement of a cartridge element without unsanitary contact with contaminated portions thereof.

According to yet another feature of the invention, the cartridge element is rhombic with a front surface, a rear surface, a top surface, a bottom surface and first and second side surfaces. The rhombic form provides efficient humidification.

According to another feature of the invention, the retainer includes first and second spaced apart and substantially vertical retainer elements receiving, respectively, the first and second side surfaces of the cartridge element. This arrangement allows desirable positioning of the element with a lower portion thereof in a liquid supply reservoir at the bottom of the housing.

According to still another feature of the invention, the handle is secured to the top surface. This feature facilitates handling of the cartridge element during replacement.

According to a further feature of the invention, the handle includes a channel portion received by the top surface and marginal portions of the front and rear surfaces. The channel portion facilitates securement of the handle to the element.

According to yet another feature of the invention, the handle includes a gripping portion projecting upwardly from the channel portion. The gripping portion is easily gripped during the replacement process.

According to additional features of the invention, the channel portion extends over substantially the entire length of the top surface and is secured thereto with an adhesive substance. This feature provides a secure attachment of the handle to the cartridge element.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
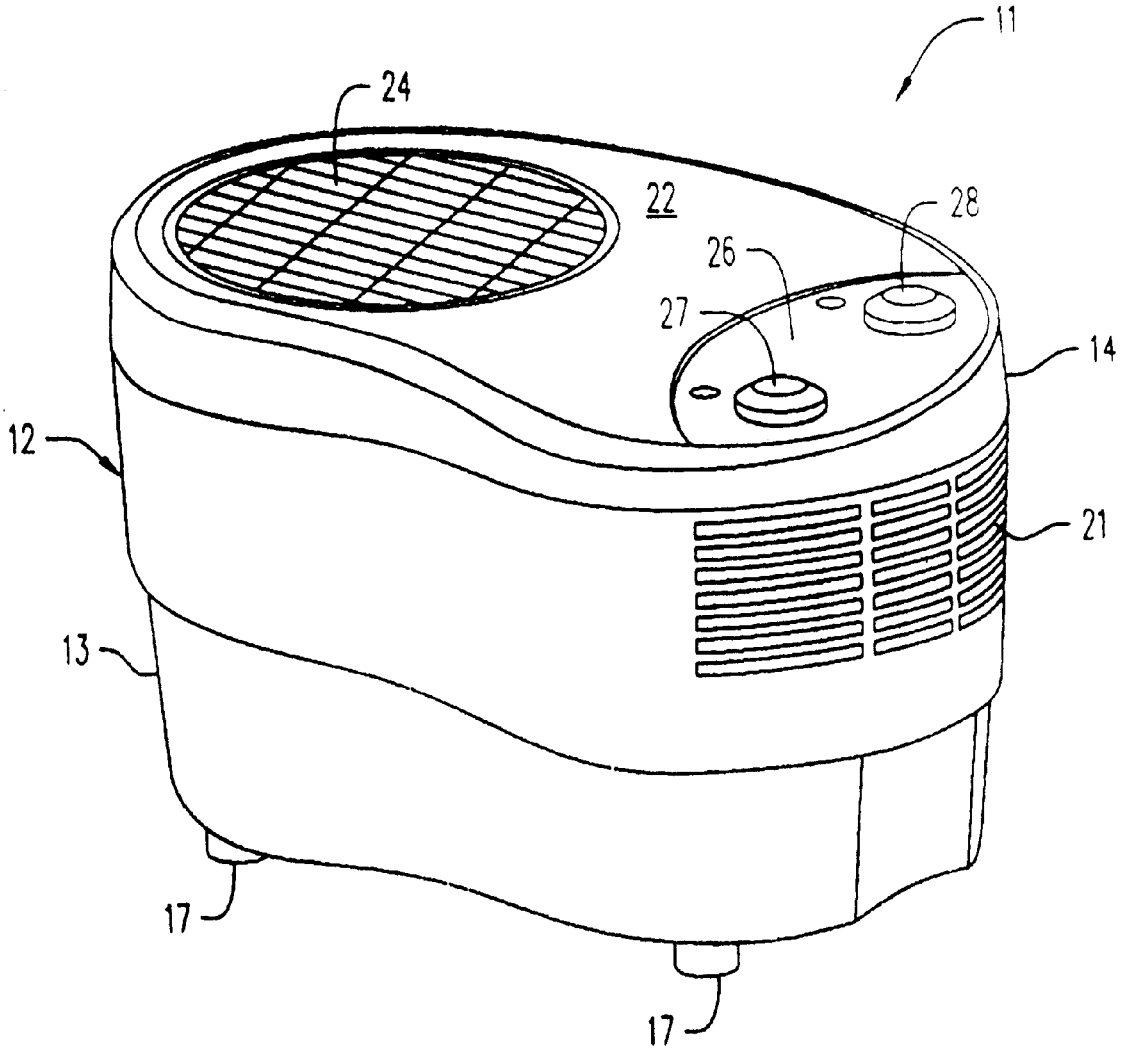
FIG. 1 is a perspective view of a portable humidifier according to the invention.
Figure 2:
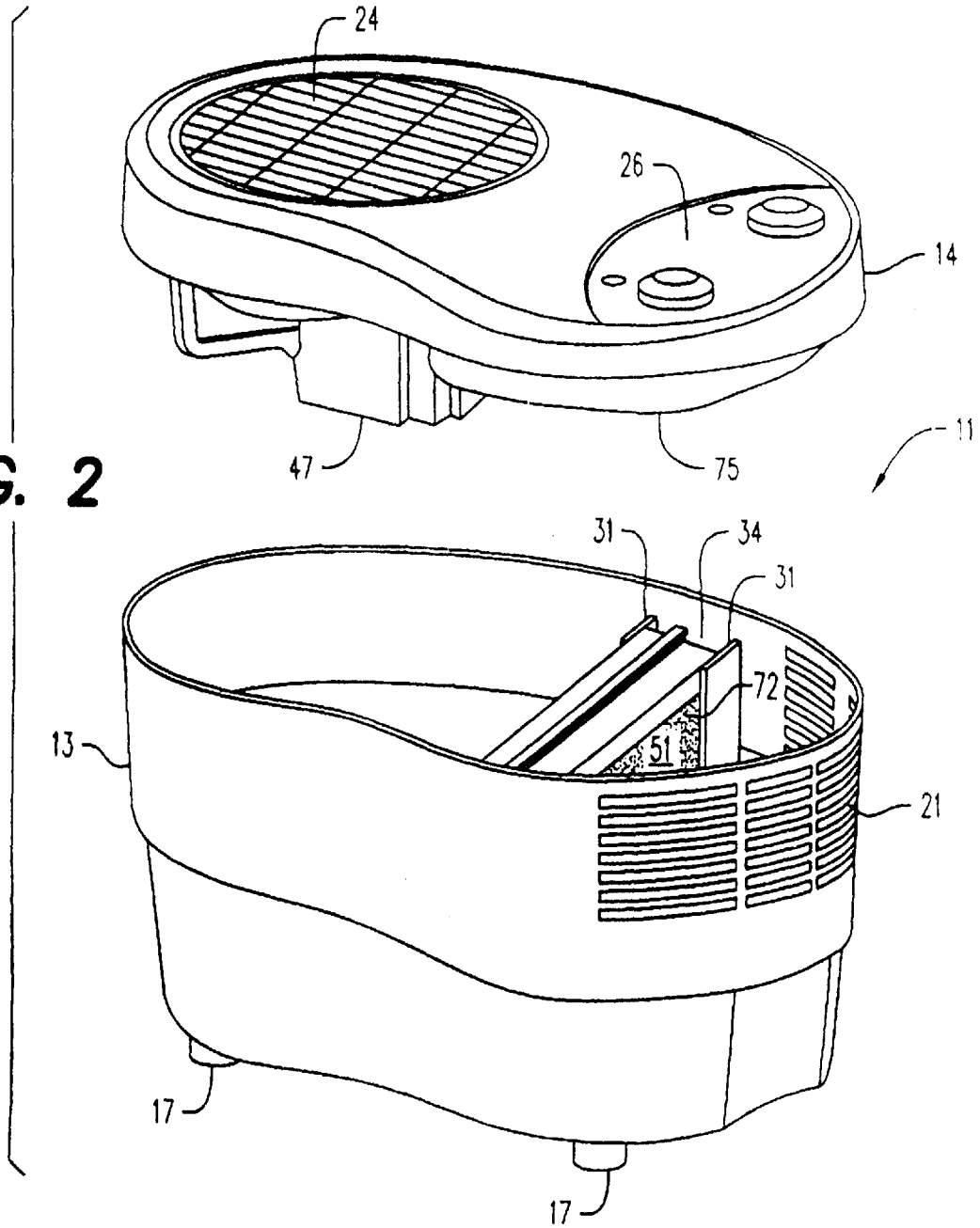
FIG. 2 is an exploded view of the humidifier shown in FIG. 1.

A portable humidifier 11 includes a housing 12 formed by a base 13 and a cover 14. The base 13 is supported by legs 17 and has a bottom portion which defines a liquid 5 supply reservoir 18. Also defined in a side wall of the base 13 is an air outlet 21. The top wall 22 of the cover 14 forms an air inlet 24 which communicates with the air outlet. 21 via an air flow path defined by the housing 12. Retained by the top wall 22 is a control panel 26 having control knobs 27, 28 for operating the humidifier 11.

Figure 3:
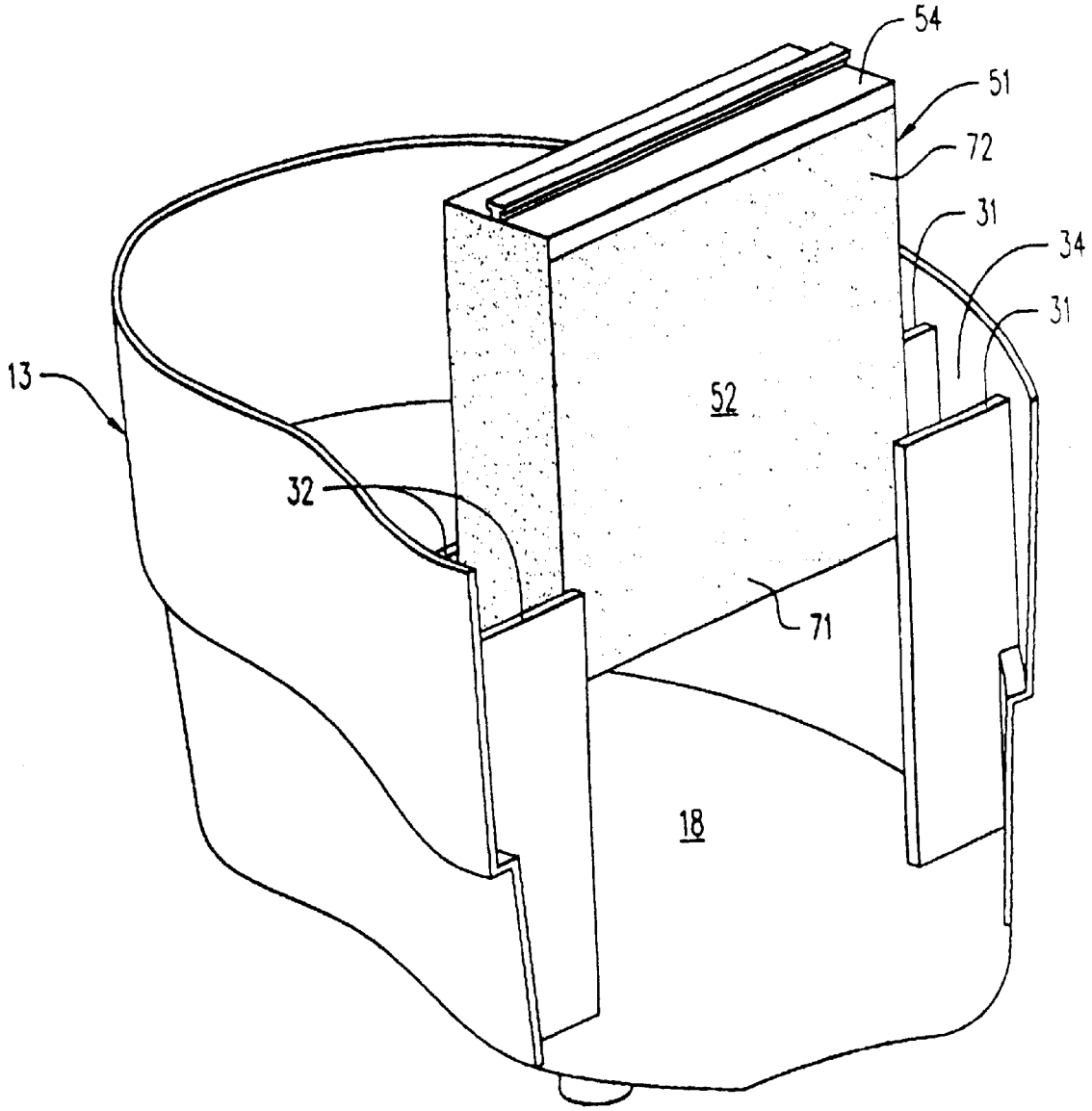
FIG. 3 is a partially cut away perspective view of a base portion of the humidifier shown in FIGS. 1 and 2.

As illustrated in FIG. 3, oppositely facing inner walls of the base 13 have inwardly extending, vertical pairs of spaced apart walls 31, 32 which form channels 34. The walls 31 and 32 are aligned and spaced apart forming a vertical slot 36 which extends into the reservoir 18. A replaceable, air permeable, liquid absorbent cartridge element 51 is replaceably retained in the base 13. Mounted on the cover 14 is an electrically energized blower 47 which can be activated to produce air flow through the air flow path extending between the air inlet 24 and the air outlet 21.

Figure 4:
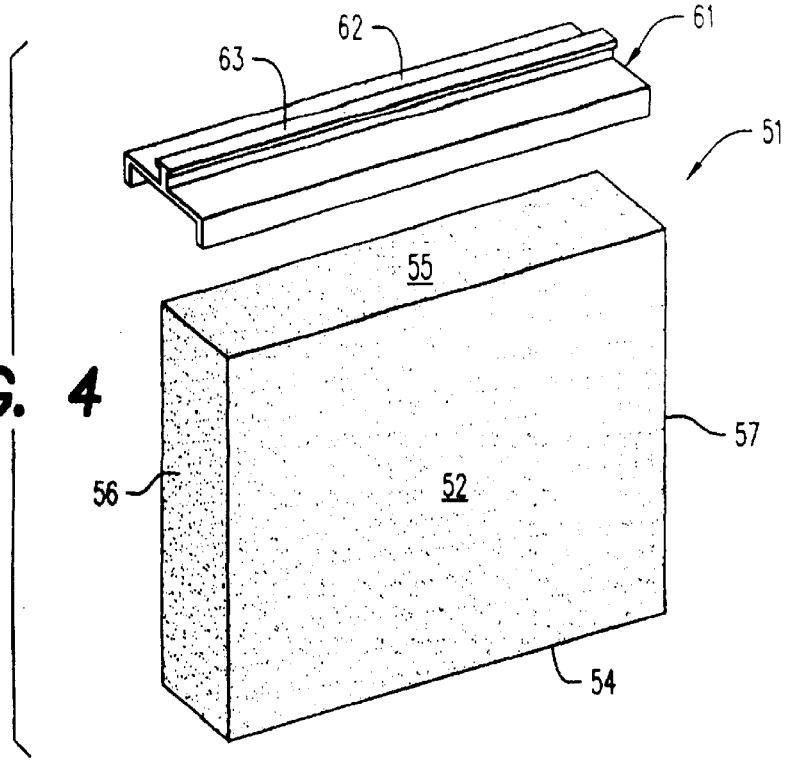
FIG. 4 is a front perspective view of a liquid absorbent cartridge element used in the humidifier of FIGS. 1–3.
Figure 5:
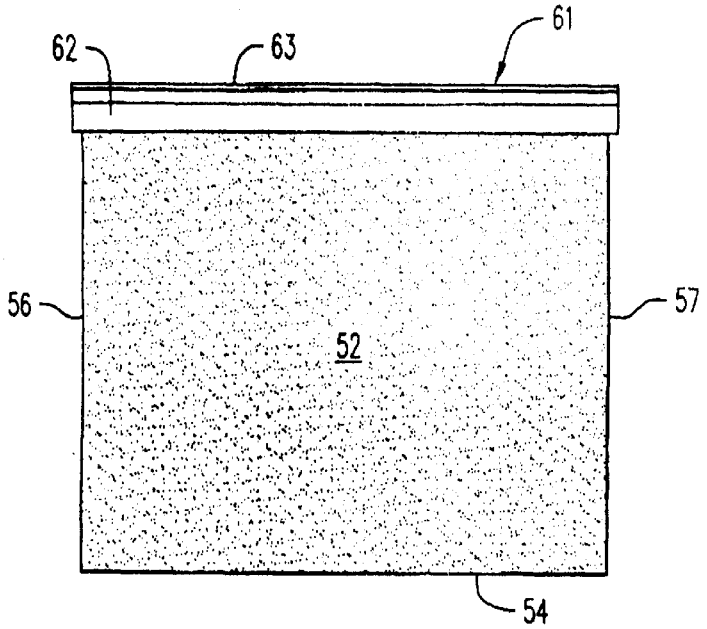
FIG. 5 is a front elevational view of the cartridge element shown in FIG. 4.
Figure 6:
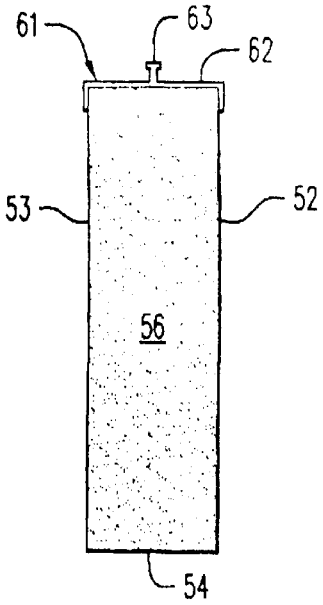
FIG. 6 is a side view of the cartridge element shown in FIG. 4.

As shown in FIGS. 4 and 5, the cartridge element 51 is rhombic with a front surface 52, a rear surface 53, a bottom surface 54, a top surface 55, a first side surface 56 and a second side surface 57 as shown in FIGS. 4 and 5. Receiving the first and second side surfaces 56, 57 are the slots 36 in the base 13. Also included with the element is a handle 61 secured to the top surface 55. Forming the handle 61 is a channel portion 62 which engages the top surface 55 and upper marginal portions of the front surface 52 and rear surface 53 and a gripping portion 63 projecting upwardly from the channel portion 62. Preferably, the channel portion 62 and gripping portion 63 extend along substantially the entire length of the top surface 55. The channel portion 62 is secured to the element 51 with a suitable adhesive. With the cartridge element 51 pressed into the slots 36, a lower portion 71 of the cartridge element 51 is located in the reservoir 18 of the base 13 while an upper portion 72 is disposed in the air flow path between the air inlet 24 and the air outlet 21.

Prior to use of the humidifier 11, the cover 14 is removed and the reservoir 18 in the base 13 filled with water from a suitable tap. The cover 14 then is replaced on the base 13 and a closure projection 75 engages top edges of the walls 31, 32 and the top surface 54 of the cartridge element 51 to establish between the air inlet 24 and the air outlet 21 an air flow path which includes another portion 72 of the cartridge element 51. Water in the reservoir 18 saturates the lower portion 71 of the cartridge element 51 and moves upwardly by capillary action to also saturate the upper portion 72 of the element 51. After activation of the humidifier 11 by manipulation of the knobs 27, 28, the blower 47 is activated to produce between the inlet 24 and outlet 21 air flow which entrains water in the upper portion 72 of the cartridge element 51 and thereby supplies moisture to the environment surrounding the humidifier 11.

After a certain operating period, the cartridge element 51 will become clogged with dirt particles carried by the air flow between the air inlet 24 and outlet 21. Consequently, air flow is reduced and the operating efficiency of the humidifier 11 significantly diminished. At that time, the clogged cartridge element 51 is removed from the humidifier 11 and replaced by a replacement element. Replacement of the cartridge element 51 is accomplished by first removing the cover 14 from the base 13. Next, the elongated gripping portion 63 of the handle 61 is gripped and the element 51 is withdrawn from the slots 36 in the base 13. Finally, a new replacement element 51 is positioned in the slots 36. Because of the handle 61, a user does not contact the contaminated body portion of the filter element 51 during the removal process.

Obviously, many modifications and variations of the present invention are possible in light of the above teachings. It is to be understood, therefore, that the invention can be practiced otherwise than as specifically described.

What is claimed is:

1. A portable humidifier comprising:

a housing defining a liquid reservoir, an air inlet, an air outlet, and an air flow path therebetween;

a liquid absorbent cartridge removably located in the housing in said air flow path and disposed to receive liquid from said reservoir, the cartridge including a front surface, a rear surface, a top surface, a bottom surface, and first and second side surfaces;

a handle including a channel portion secured only to portions of the top surface, front surface and rear surface such that no portion of the handle extends into said cartridge; and a blower for producing air flow through said air flow path and past said cartridge.

2. The portable humidifier according to claim 1 wherein said cartridge is rhombic.

3. The portable humidifier according to claim 1 wherein said handle further comprises a gripping portion projecting upwardly from said channel portion.

4. The portable humidifier according to claim 1 wherein said channel portion extends over substantially an entire length of said top surface.

5. The portable humidifier according to claim 4 wherein said channel portion is secured to said top surface with an adhesive.

6. The portable humidifier according to claim 1 wherein said liquid reservoir is disposed in a lower portion of said housing and receives a lower portion of said cartridge.

7. The portable humidifier according to claim 3 wherein the gripping portion extends over substantially an entire length of the handle.

8. The portable humidifier according to claim 6 further comprising a retainer in the housing for removably retaining the cartridge in the air flow path.

9. The portable humidifier according to claim 8 wherein said retainer further comprises first and second spaced apart and substantially parallel retainer elements receiving, respectively, said first and second side surfaces.

10. The portable humidifier according to claim 9 wherein said first and second retainer elements are substantially vertical slots defined by said housing.

11. The portable humidifier according to claim 10 wherein said handle further comprises a gripping portion projecting upwardly from said channel portion.

12. The portable humidifier according to claim 11 wherein said channel portion extends over substantially an entire length of said top surface.

13. The portable humidifier according to claim 12 wherein said channel portion is secured to said top surface with an adhesive.

14. A portable humidifier comprising:

a housing defining a liquid reservoir, an air inlet, an air outlet, and an air flow path therebetween;

a liquid absorbent cartridge removably located in the housing in the air flow path and disposed to receive liquid from the reservoir, the cartridge including a front surface, a rear surface, a top surface, a bottom surface and first and second side surfaces;

a handle including a channel portion having a length, the channel portion receiving portions of the top surface, the front surface and the rear surface of the cartridge, and a gripping portion extending upwardly from the channel portion and along the length of the channel portion and adapted to be grippable by a thumb and fingers of a hand, such that the gripping portion is capable of being held by a hand; and a blower for producing air flow through the air flow path and past the cartridge.

15. The portable humidifier according to claim 14 wherein the handle is secured to only portions of the top surface, front surface and rear surface of the cartridge such that no portion of the handle extends into the cartridge.

16. The portable humidifier according to claim 14 wherein the channel portion extends over substantially an entire length of the top surface.

17. The portable humidifier according to claim 14 wherein the channel portion is secured to the top surface with an adhesive.

18. The portable humidifier according to claim 14 wherein the liquid reservoir is disposed in a lower portion of the housing and receives a lower portion of the cartridge.

19. The portable humidifier according to claim 18 further comprising a retainer disposed in the housing for removably retaining the cartridge in the air flow path.

20. The portable humidifier according to claim 19 wherein the retainer further comprises first and second spaced apart and substantially parallel retainer elements receiving, respectively, the first and second side surfaces.

21. The portable humidifier according to claim 20 wherein the first and second retainer elements are substantially vertical slots defined by the housing.

22. A portable humidifier comprising:

a housing defining a liquid reservoir, an air inlet, an air outlet, and an air flow path therebetween;

a liquid absorbent cartridge removably located in the housing in the air flow path and disposed to receive liquid from the reservoir, the cartridge including a front surface, a rear surface, a top surface, a bottom surface, and first and second side surfaces;

a handle disposed on the cartridge, the handle including a channel portion extending over the entire top surface of the cartridge, the channel portion having opposite side portions and a top portion adjacent the top surface of the cartridge provided between the side portions, the two side portions adapted to be grippable by a thumb and fingers of a hand for gripping the handle for removing or inserting the cartridge in the housing; and a blower for producing air flow through the air flow path and past the cartridge.

23. The portable humidifier according to claim 22 wherein the cartridge element is rhombic.

24. The portable humidifier according to claim 22 wherein the handle is secured to a portion of the top surface, such that no portion of the handle extends into the cartridge.

25. The portable humidifier according to claim 22 wherein the channel portion is secured to the top surface with an adhesive.

26. The portable humidifier according to claim 22 wherein the handle further comprises a gripping portion projecting upwardly from the channel portion.

27. The portable humidifier according to claim 26 wherein the gripping portion extends over substantially an entire length of the channel portion.

28. The portable humidifier according to claim 27 where the gripping portion includes a T-shaped cross-section.

* * * * *